US005673951A

United States Patent [19]

Bottaro

[11] Patent Number: 5,673,951

[45] Date of Patent: Oct. 7, 1997

[54] SECURITY DEVICE

[76] Inventor: Peter Bottaro, 32 Pacific St., North Babylon, N.Y. 11703

[21] Appl. No.: 607,286

[22] Filed: Feb. 26, 1996

Related U.S. Application Data

[63] Continuation-in-part of Ser. No. 345,238, Nov. 28, 1994, Pat. No. 5,524,943.

[51] Int. Cl.[6] ..... E05C 17/16

[52] U.S. Cl. ..... 292/268; 292/262; 292/269

[58] Field of Search ..... 292/56, 120, 218, 292/300, 302, 262, 263, 273, 276, 266, 269, DIG. 19

[56] References Cited

U.S. PATENT DOCUMENTS 4,062,578 12/1977 Chen ..... 292/262

4,475,753 10/1984 D'Ath ..... 292/268

5,577,783 11/1996 Kaminski ..... 292/262

FOREIGN PATENT DOCUMENTS 2267728 12/1993 United Kingdom ..... 292/262

*Primary Examiner*—Steven N. Meyers
*Assistant Examiner*—Tuyet-Phllong Pham
*Attorney, Agent, or Firm*—Stanley Ira Laughlin

[57] ABSTRACT

The invention relates to a security device for doors or windows for foiling unwanted entry into a secured facility comprising a limited rotational vertical rod having a plurality of parallel horizontal rods extending from said vertical rod. The parallel horizontal rods are positioned into a locked position against the interior door, into a partially open position by holding the edge of the door with curved ends and into an unlocked position away form the door.

11 Claims, 3 Drawing Sheets

SECURITY DEVICE

This application is a continuation-in-part of application Ser. No. 08/345,238, filed Nov. 28, 1994 and now U.S. Pat. No. 5,524,943.

BACKGROUND OF THE INVENTION

The invention relates to a security device for preventing unwanted entry into a home, office or other secured facility by re-enforcing any door or window with a plurality of parallel horizontal rods made out of iron, brass or other strong metal extending out of a vertical rod attached to the side opposite to the hinge side of the door frame for limited rotation in order to hold the device in a locked position until the rod is rotated to partially open the device a predetermined amount to investigate. Although Applicant's invention operates somewhat like the conventional chain locks, which secure only a small area on the door and can be kicked in, Applicant's invention applies pressure against entry to a greater area of the door.

It may be recognized that a plurality of horizontal rods may not be required even though only a small area is covered because that small area can not be kicked in since it is the nature of the invention when additional pressure is placed upon the door to feed the pressure back against the door instead of loosening the hardware of the door as results from conventional latching devices.

TECHNICAL FIELD

The invention relates to security devices for doors and windows in general and specifically security doors and windows employing locking devices such as classified in Class 49 subclasses 62, 169, 170 and 171.

SUMMARY OF THE INVENTION

The invention relates to security devices for doors and windows that are protected against unwanted entry by attaching to the interior frame of the door or window a vertical rod having a plurality of parallel horizontal rods extending out of it. The rod is rotatably mounted on the door or window frame for positioning the plurality of parallel horizontal rods against the door or window and locking it, for positioning the parallel horizontal rods at a predetermined distance in order to partially open the door or window while investigating, and for positioning the parallel horizontal rods out of the way so that the door or window may be fully opened.

The closest prior art is the security door described in U.S. Pat. No. 4,912,877 to Strydon having a plurality of vertical bars hinged in an outer door, which in turn is hinged within a second door. Applicant's invention distinguishes from the Strydon structure in that there is only one door or window and the horizontal rods are positioned against the interior of the door or window, and not within said door or window.

Likewise Applicant's invention distinguishes over U.S. Pat. No. 1,580,826 issued to Haenssler which shows exterior security bars over a small portion of the door.

U.S. Pat. No. 5,018,302 to Kluge shows only adjustable exterior horizontal bars over a window, and is not relevant to Applicant's invention.

It is an object of Applicant's invention to provide safe, economical and simple security means for existing doors and windows.

It is also an object of Applicant's invention to provide decorative security means for a door and window without extensive remodeling.

It is a further object of Applicant's invention to provide security that is easily installed to a door and window.

It is a further object of applicant's invention to provide security form only a single or pair of horizontal rods to an area less than the area of a door or window without lessening the ability of the invention to secure said door or window.

DETAILED DESCRIPTION

Figure 2:
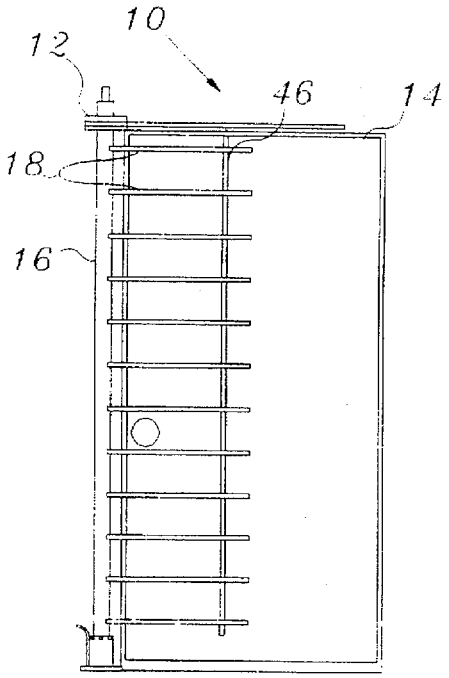
FIG. 2 is a front elevation view showing Applicant's security device for a door in its closed or locked position.
Figure 1:
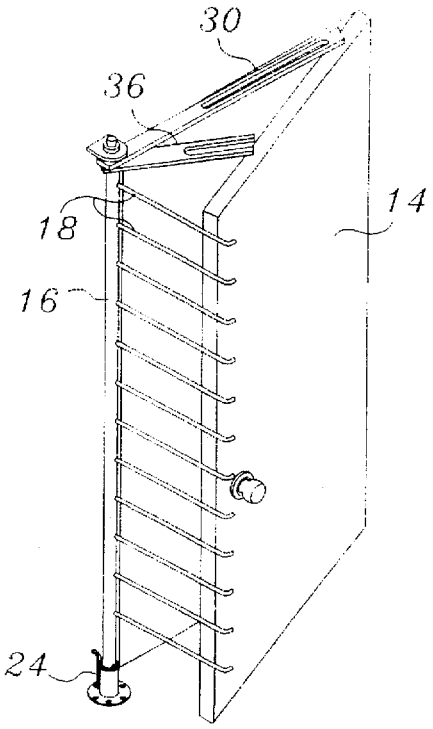
FIG. 1 is a perspective drawing of Applicant's security device for a door shown in its partially opened position.
Figure 3:
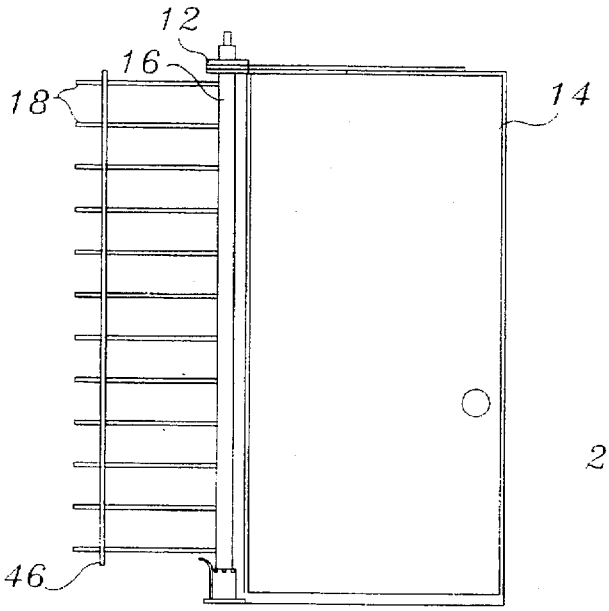
FIG. 3 is a front elevation view showing Applicant's security device for a door in its fully opened position.

FIG. 1 shows Applicant's security device 10 for a door 14 in its partially opened position. Attached to the door frame 12 of a wood or steel door 14 is a steel or other metallic vertical rod 16 having a plurality of parallel steel or other metallic rods 18 extending orthogonally from said rod 16 which is capable of rotation in top and bottom busings 26 and 20 shown in FIG. 4. The end of the rods 18 opposite to the rod 16 are curved to encircle the door, and secure the door form external forced entry when the door is partially opened. FIGS. 2 and 3 show Applicant's security door 10 in its locked and unlocked positions, and it is noted that the door has to be returned to its locked position form its partially opened position before it can be placed into its unlocked position.

Figure 4:
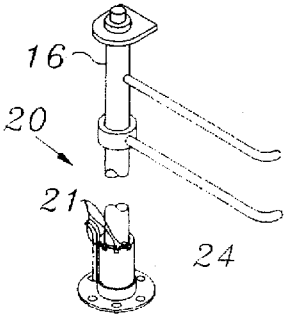
FIG. 4 is a perspective view of one of the details of Applicant's security device for a door.
Figure 5:
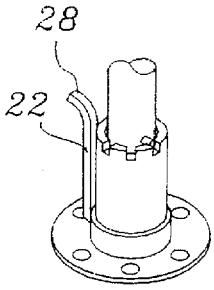
FIG. 5 is a perspective view of another embodiment of the detail drawing shown in FIG. 4.
Figure 6:
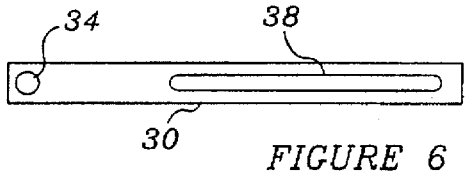
FIG. 6 is a plan view of another detail of Applicant's security device.
Figure 8:
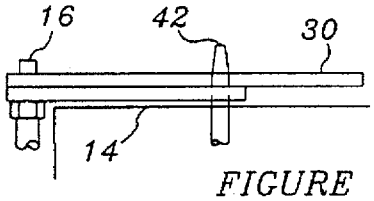
FIG. 8 is a elevation view of the details shown in FIGS. 6 and 7 cooperating in a closed position of Applicant's security device for a door.
Figure 7:
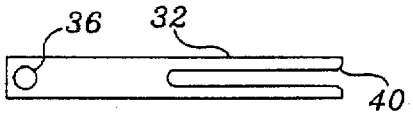
FIG. 7 is a plan view of yet another detail of Applicant's security device.

FIG. 4 shows vertical rod 16 within lower bushing 20 which comprises a base 24 to which a section of pipe 22 is welded. The top of pipe 22 has three cutouts 21 which mate with extension pins not shown of vertical rod 16 to provide the three different positions of rod 16 when it is inserted into bushing 20. Lower bushing 20 can be modified as shown in FIG. 5 to incorporate a lever 278 for facilitating the movement of vertical rod 16 into the three positions; namely: the locked partially opened or unlocked positions of the security door. As stated previously, the peripheral positions of the three cutouts determine that the door has to be returned to its locked position before it can be placed into its unlocked position.

FIGS. 6, 7, 8 and 9 show an additional feature of Applicant's security door to prevent entry from outside through the top of the door or window. Flanges 30 and 32 are placed at one end through holes 34 and 36 on to vertical rod 16 and through slot 38 of flange 30 and slotted area 40 on flange 32 through an extension 42 on the top of the door 14, cooperating to provide security for the top of the door or window when it is opened.

Figure 10:
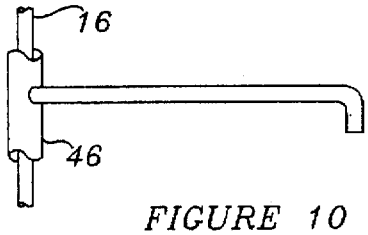
FIG. 10 is a detailed perspective view of one of the horizontal rods of Applicant's security door.
Figure 9:
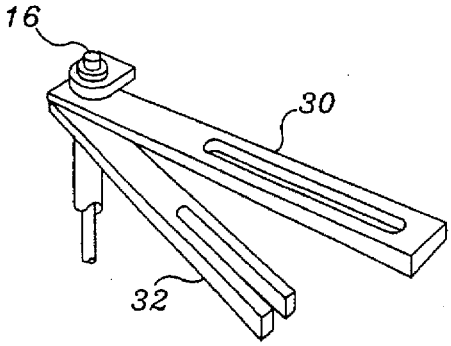
FIG. 9 is a perspective view of the details shown in FIGS. 6 and 7 cooperating in a partially opened position of Applicant's security device for a door.
Figure 11:
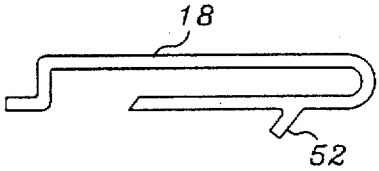
FIG. 11 is a detailed perspective view of another embodiment of one of the horizontal rods shown in FIG. 10.

FIG. 11 is another embodiment of the horizontal parallel rod 18 shown in FIG. 10. The advantages of this embodiment over the horizontal parallel rod 18 is that in addition to holding the door against unauthorized entry, it provides window means for permitting the passage of packages when the door or window is in its partially opened position without fully unlocking the security device and opening the door or window. One end of the horizontal parallel rod embodiment shown in FIG. 11 encircles the vertical rod 16 and is held in position by additional extension pins not shown of vertical rod 16.

Figure 12:
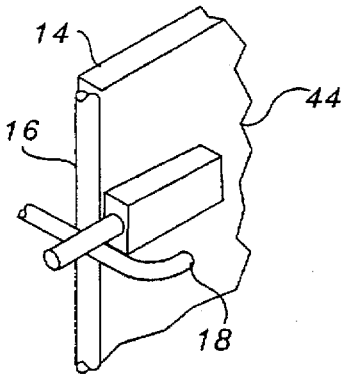
FIG. 12 is a perspective view of an additional detail of Applicant's security device.

FIG. 12 shows an additional detail for use with Applicant's security door comprising a rod 44 extending form door 14 to rest upon one of the horizontal parallel rods 18. Any attempt to breach the security door by lifting up the door or manipulating the position of the vertical rod will be foiled.

Figure 15A:
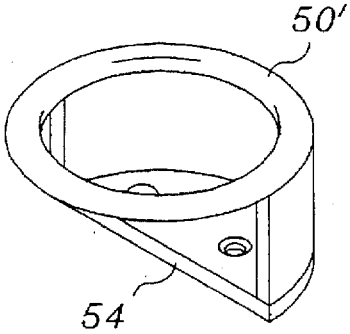
FIG. 15*a* shows a oval ring and FIG. 15*b* shows a circular ring latch properly mounted on a door interacting with a rod which is a modification of the rod of FIG. 11.
Figure 15B:
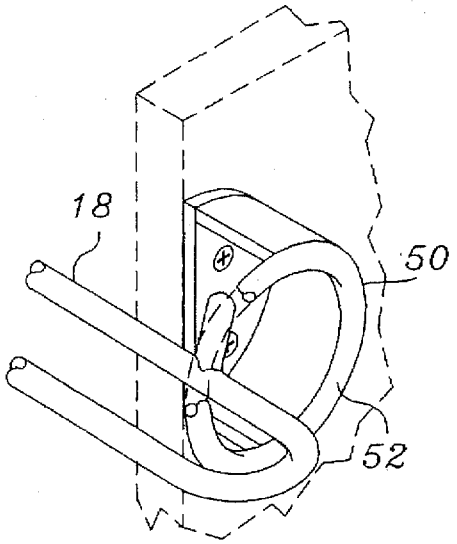
Figure 16:
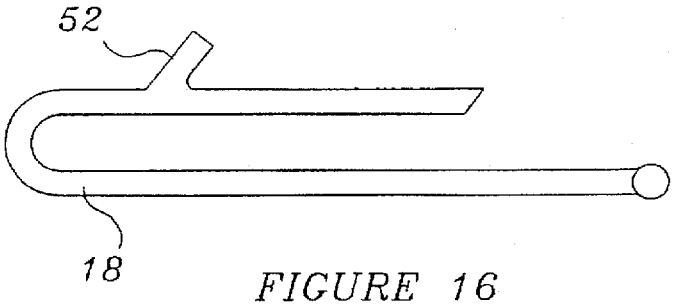
Figure 15C:
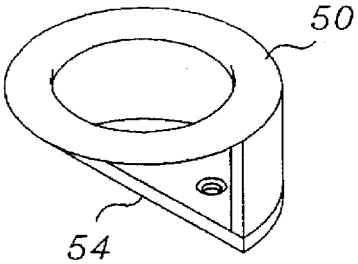
FIG. 15*c* shows a square ring.
Figure 15D:
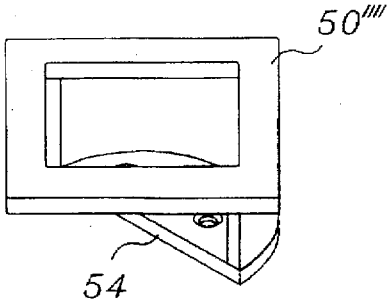
FIG. 15*d* shows a circular ring.
Figure 15E:
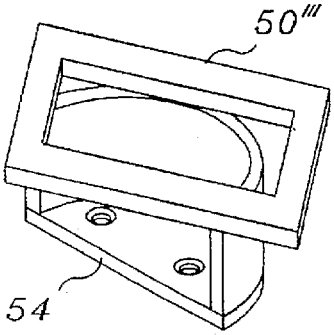
FIG. 15*e* shows a triangular ring.
Figure 15F:
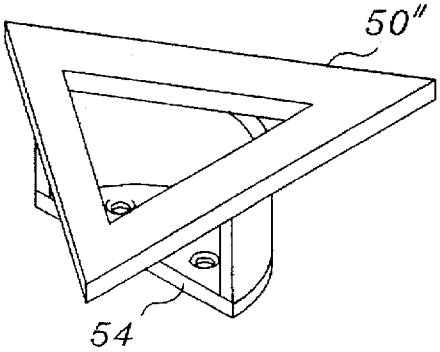
FIG. 15*f* shows a rectangular ring.

A modified version of the horizontal rod of FIG. 11 as shown in FIG. 16 where it is used in combination with circular ring 50 to provide the latching means shown in FIGS. 15*b*. Although a circular ring is illustrated, the shape of the ring should not be so limited, since applicant's inventive latching device comprises oval, triangular, rectangular, square and any other shape known. When the door is in the closed or opened position, the rod 18 extending form rotatable rod 16 can be pushed to an out of the way position or inserted into the ring 50 on the door. When the door begins to open, the ring travels on the rod until the protrusion 52 extending out of the rod 18 engages the ring and stops the movement of the door and by being within the ring strikes steel plates 54 at the bottom of ring 50 thereby resulting in the protrusion 52 pressing against the door. Further attempts to forcefully open the door only results in further pushing the protrusion 52 harder against the steel plates 54, which in turn pushes harder against the door. Unlike other door latching devices in which an attempted break in rips the hardware away from the door, applicant's inventive device, even through requiring smaller size screws to hold the device on the door, results in increased pressure on the door and its hardware whenever additional force is exerted to open the door further than permitted.

Figure 13:
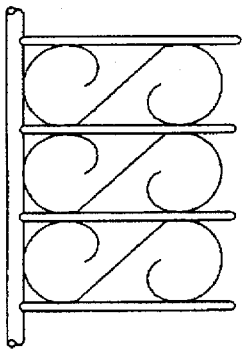
FIG. 13 is a front elevation view of decorative decor that is compatible with Applicant's security device for a door.

FIG. 13 shows how the horizontal parallel rods may be modified so as to have a decorative effect.

Figure 14:
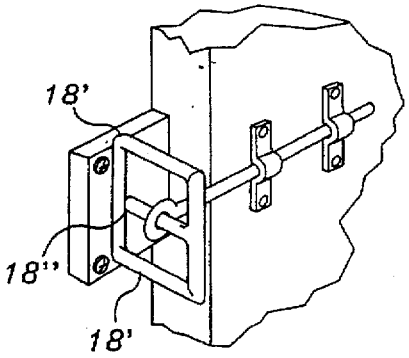
FIG. 14 is a perspective view of yet another embodiment of a simpler version of applicant's security device.

FIG. 14 shows a much simpler embodiment of Applicant's invention. A pair of shortened horizontal parallel bars 18' joined together at the ends away from the door or window by a "tee" shaped metal piece 18". A moveable eye bolt extends from supporting brackets on the door and engages the central stem of the Tee when moved before the door or window is opened, allowing only a partial opening until stopped by the device. Operation of Applicant's Security device is very simple, and only requires manipulation of the vertical rod 16 in conjunction with the door handle to move the door from the closed or locked position to the partially opened position. To fully open the door, it will be necessary to return to the locked position to clear all the safety bars, and then move the vertical rod 16 to the unlocked position. Additional locking features incorporated into the system such as locks will have to be cleared at the proper time. Operation of the simplified embodiment only requires that the eyebolt is moved from its neutral position on the door while the door is locked to engage the hole in the eyebolt. The door is then opened only to the partially opened position because it will be stopped by the eyebolt moving along the central stem of the Tee when it reaches the crossarms of the Tee.

Although only a limited number of embodiments have been shown, it is expected that Applicant's invention will not be so limited, but will be only limited by the scope and breadth of the annexed claims:

I claim:

1. A security device comprising a rotatable vertical rod positioned between upper and lower bushings encircling said vertical rod adjacent to an opening side of an inwardly opening door, at least one open ended rod extending from said vertical rod and circling back upon itself to form an elbow, a ring extending from a strike plate mounted upon the interior edge of said door and positioned to receive the open end of said rod when said door is closed, said rod having a protrusion, with a length less than the diameter of said ring, projecting therefrom and positioned at a distance from the elbow which is greater than the distance between said ring and said strike plate to stop said ring, said strike plate and said door by pressing upon said strike plate and door through said ring when said door is opened to its partially opened position.

2. A security device as claimed in claim 1 wherein said strike plate is spaced behind said ring wherein said protrusion presses upon said plate whenever said door is in its partially opened position.

3. A security device as claimed in claim 1 wherein said pressing upon said door through said ring and plate reduces the pressure to remove said plate from said door even when additional pressure is exerted upon said door in its partially opened position.

4. A security device as claimed in claim 1 wherein said ring comprises a circular shape.

5. A security device as claimed in claim 1 wherein said ring comprises an oval shape.

6. A security device as claimed in claim 1 wherein said ring comprises a triangular shape.

7. A security device as claimed in claim 1 wherein said ring comprises a rectangular shape.

8. A security device as claimed in claim 1 wherein said ring comprises a square shape.

9. A security device as claimed in claim 1 wherein said open ended rod extending from said vertical rod extends horizontally.

10. A security device as claimed in claim 1 wherein said open ended rod extending from said vertical rod circles back parallel upon itself.

11. A security device as claimed in claim 1 wherein the protrusion of said open ended rod is proximate to the area where the rod circles back upon itself.

* * * * *